United States Patent [19]

Manzoni

[11] 4,365,490

[45] Dec. 28, 1982

[54] LOCKING DEVICE FOR USE ON SUITCASES

[76] Inventor: Stéphane Manzoni, 1, rue Pasteur, Saint Claude, France, 39200

[21] Appl. No.: 135,637

[22] Filed: Mar. 31, 1980

[30] Foreign Application Priority Data

Apr. 6, 1979 [FR] France ..... 79 08863

[51] Int. Cl.[3] ..... E05B 65/52

[52] U.S. Cl. ..... 70/70; 70/71; 292/30; 292/221; 292/DIG. 48; 312/218

[58] Field of Search ..... 70/71, 70, 69, 67, 66, 70/153, 150; 292/30, 53, 221, 127, 225, 50, 227, DIG. 48, 49, 224, 48, 223, 47, 222, 45, 220, DIG. 18; 312/219, 218

[56] References Cited

U.S. PATENT DOCUMENTS

| | | | |
|---|---|---|---|
| 257,334 | 5/1882 | Huppe | 70/66 |
| 477,331 | 6/1892 | McKinnon | 70/66 |
| 1,125,754 | 1/1915 | Sohn | 292/DIG. 18 |
| 1,145,541 | 7/1915 | Binkley | 70/70 |
| 1,370,941 | 3/1921 | Binkley | 70/70 |
| 2,344,705 | 3/1944 | Krause | 292/221 |
| 2,646,719 | 7/1953 | Spriggs | 292/109 X |
| 2,752,773 | 7/1956 | Abelson et al. | 70/153 X |
| 2,893,773 | 7/1959 | Clifton, Jr. | 292/223 |
| 3,135,105 | 6/1964 | Brody | 70/71 |
| 3,314,703 | 4/1967 | Fitzpatrick | 292/30 X |
| 3,707,862 | 1/1973 | Pastva, Jr. | 70/150 |

FOREIGN PATENT DOCUMENTS

| | | | |
|---|---|---|---|
| 235289 | 6/1911 | Fed. Rep. of Germany | 292/53 |
| 21686 | 3/1947 | Finland | 292/48 |
| 1139917 | 2/1957 | France . | |
| 242572 | 11/1925 | United Kingdom | 70/70 |
| 533722 | 2/1941 | United Kingdom | 292/221 |

*Primary Examiner*—Ramon S. Britts
*Assistant Examiner*—Carl F. Pietruszka
*Attorney, Agent, or Firm*—Lewis H. Eslinger

[57] ABSTRACT

A locking device for use on suitcases comprising two keepers, each having a lateral notch and with an outermost surface inclined to form a cam, two lock-staples inside of which are engaged the keepers, latch hooks pivotally mounted in the lock-staples, which hooks are adapted to engage in the notches provided in the keepers under the action of elastic members when the suitcase is in its closed position, the latch hooks being connected to an opening control bar and to a locking bar, both bars being mounted for axial sliding movement inside a housing of the suitcase.

8 Claims, 15 Drawing Figures

FIG. 3
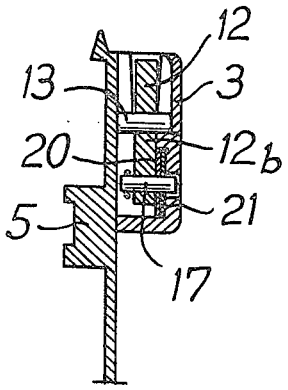
FIG. 2
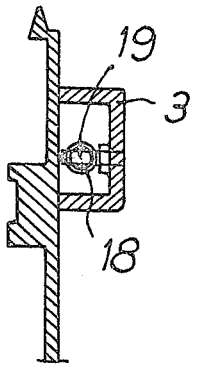
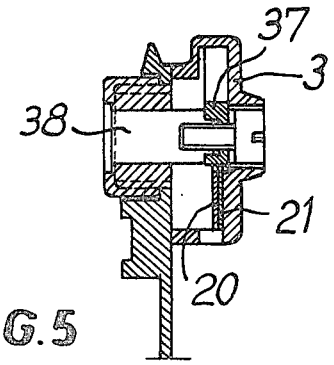
FIG. 5
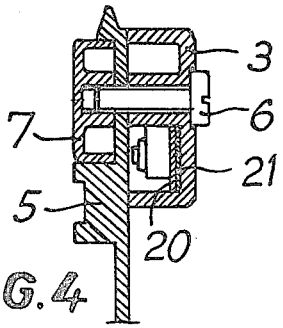
FIG. 4
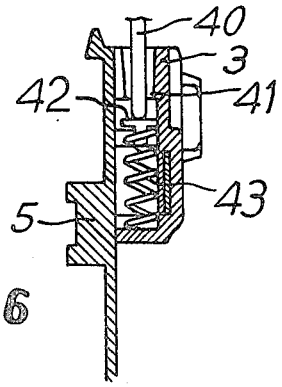
FIG. 6
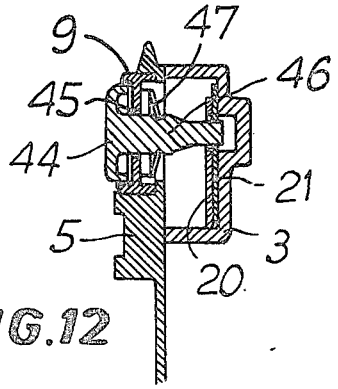
FIG. 12

FIG. 11
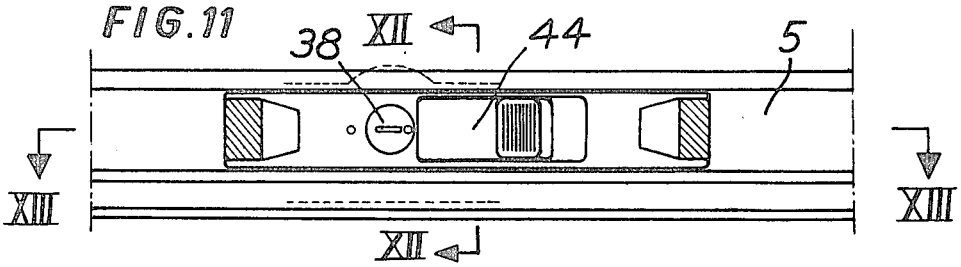
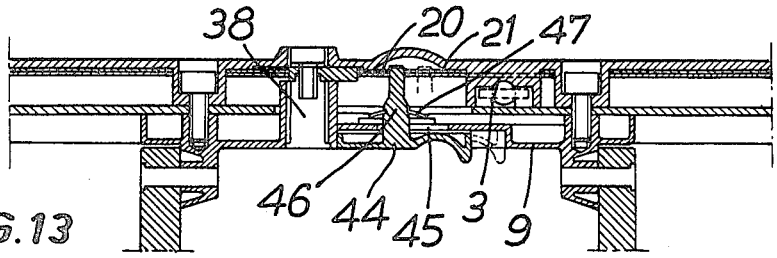
FIG. 13
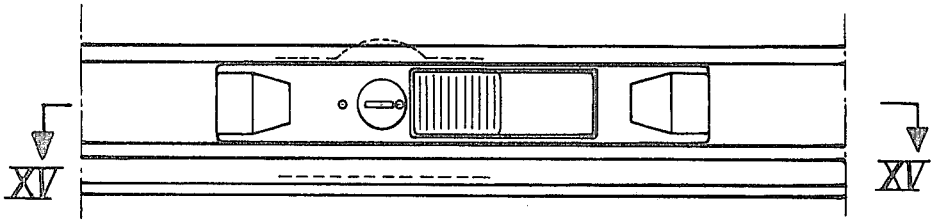
FIG. 14
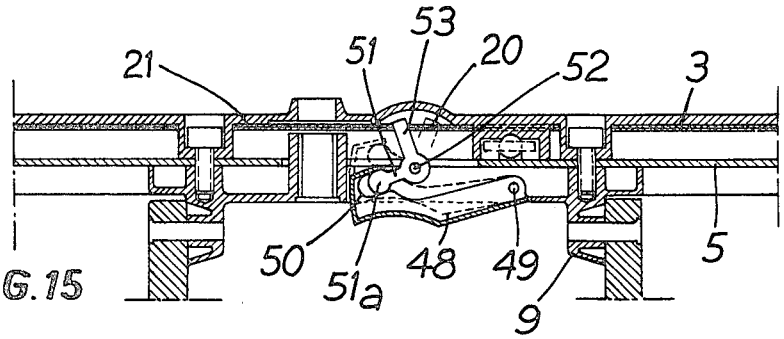
FIG. 15

LOCKING DEVICE FOR USE ON SUITCASES

The present invention relates to a locking device to be used on suitcases in particular.

Various locking devices are known which are used, for example, for locking suitcases and which comprise keepers, integral with one of the elements of the suitcase, and which engage in holes provided in sliding bars situated in the other element of the suitcase.

The fastening of these locks implies however a synchronous movement of the holed bars in order to obtain a satisfactory locking, especially when the suitcase is overfull. In other words, the keepers must generally be inserted in the holes at the same time to effect closing of the suitcase.

It has also been noted, with existing conventional locking devices, that five or six operations are needed to close a suitcase and about four operations to open it. For example, to close and lock a suitcase, the suitcase is closed, two latch mechanisms on opposite sides of the suitcase are actuated, and two lock mechanisms are actuated independently for each latch mechanism. The reverse operation is performed for opening the suitcase.

Finally, the dismantling of the locking device fitted on a suitcase is often impossible because of its being incorporated to the elements of the container.

It is the object of the present invention to propose a locking device which makes it possible to overcome the aforesaid disadvantages.

According to the present invention, latch hooks are pivotally mounted in lock-staples, which hooks latch are adapted to engage in notches in the keepers, under the action of resilient members, the latch hooks being connected with a bar controlling the opening and a bar controlling the locking, which bars are mounted for sliding movement axially inside a housing.

It is possible with this arrangement to close the suitcase, even it it is overfull, first by exercising a pressure on a first side of the suitcase to close said first side and second by exercising a pressure on the other side to close the second side without having to unlock the first side which is already closed.

According to another feature of the invention, the housing is provided in its central part with a recess inside which is engaged, in the closed position, the end of a guiding finger integral with the element of the suitcase which carries the keepers, the finger being biased out of the recess by means of a push button provided at the bottom of the recess and subjected to the action of an elastic member.

With this arrangement, the suitcase is easily opened, the opening being helped by the pushbutton acting on the guiding finger.

Regarding the manipulation of the locking device according to the invention, this consists of only three operations for opening or closing, whereas with conventional locks, a larger number of operations are necessary. For example, with this invention, all that is necessary is to close the suitcase and turn the key in lock 38. In opening the suitcase, all that is necessary is to turn the key in lock 38 in the opposite direction, actuate push button 30 and open the suitcase.

Finally, the use of flexible bars for controlling the latch hooks makes it possible for the locking device to be fitted on any type of luggage with a rounded outline.

The invention will be more readily understood on reading the following description of several embodiments with reference to the accompanying drawings in which:

FIG. 2 is a cross-sectional view of the locking device according to this invention, taken along line II—II of FIG. 1;

FIG. 3 is a cross-sectional view of the locking device according to this invention, taken along line III—III of FIG. 1;

FIG. 4 is a cross-sectional view of the locking device according to this invention, taken along line IV—IV of FIG. 1;

FIG. 5 is a cross-sectional view of the locking device according to this invention, taken, along line V—V of FIG. 1;

FIG. 6 is a cross-sectional view of the locking device according to this invention, taken along line VI—VI of FIG. 1;

FIG. 11 is an external elevational view of another embodiment of the control means that can be used in the locking device according to this invention;

FIG. 12 is a cross-sectional view of the control means of FIG. 11, taken along line XII—XII of FIG. 11;

FIG. 13 is a cross-sectional view of the control means of FIG. 11, taken along line XIII—XIII of FIG. 11;

FIG. 14 is an external elevational view of another control means that can be used in the locking device according to this invention; and FIG. 15 is a cross-sectional view of the control means of FIG. 14, taken along line XV—XV of FIG. 14.

Figures 1, 7, 8, 9, 10:
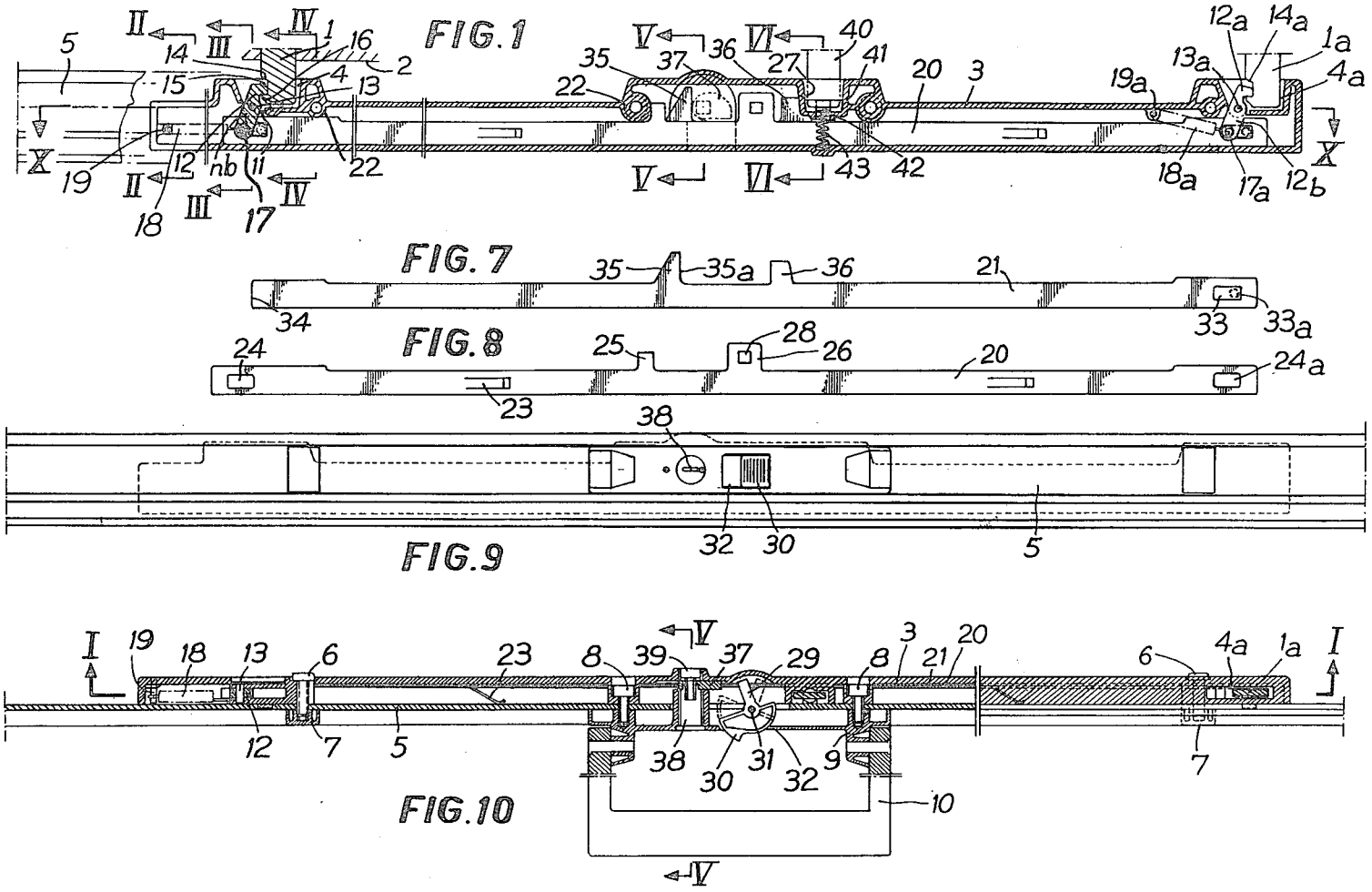
FIG. 1 is a longitudinal cross-sectional view of one embodiment of the locking device according to the invention.
FIG. 7 is an elevational view of the locking bar used in the locking device of FIG. 1.
FIG. 8 is an elevational view of the control bar used in the locking device of FIG. 1.
FIG. 9 is an external elevational view of the locking device of FIG. 1.
FIG. 10 is a partial longitudinal view of the locking device according to this invention, taken along line X—X of FIG. 1.

FIGS. 1 to 10 show an embodiment of a locking device according to the invention, comprising parallel keepers 1, 1*a* parallel which are fixed, for example, on the edge of a suitcase lid 2, the other part of the suitcase body being provided with a housing 3 containing the different members for controlling the lock and having lock-staples 4, 4*a* inside of which are engaged the keepers 1, 1*a*. The U-shaped housing 3 is provided on one side with an opening which is closed by means of a cover 5 or by the inside wall of the suitcase, the housing being fixed by means of screws 6 and nuts 7 (FIG. 4). On the cover 5 or on the inside wall of the suitcase is secured, by means of screws 8 engaged in the median part of the housing 3, a base plate 9 of a handle 10. The lock-staples 4, 4*a* inside of which are engaged the keepers 1, 1*a* are provided with openings 11 through which are engaged latch hooks 12, 12*a* mounted to pivot about axes 13 integral with the housing 3, the latch hooks being engaged, in the closed position of the suitcase, in a notch 14, 14*a* provided in each one of the keepers 1, 1*a*. In order to help the engagement of the latch hooks 12, 12*a* into the keepers 1, 1*a*, the hooks have an inclined portion 15 which cooperates, in the same way as a cam, with an inclined portion 16 of keepers.

On the opposite side of axes 13, the latch hooks 12, 12*a* are extended by a part 12*b* on which is fixed a stud 17, 17*a* and on which stud is fixed one of the ends of a helical spring 18, 18*a* (FIGS. 1,2,3), the other end being fixed on a stud 19, 19*a* integral with the housing 3. This arrangement affords the possibility of returning the hooks 12, 12*a* to a closing position, i.e. to a position where they are engaged in the notches 14, 14*a* of the keepers 1, 1*a*.

The latch hooks 12, 12*a* are actuated by means of a control bar 20 (FIGS. 1, 8 and 10) for opening the latch hooks against the action of springs 18, 18*a*, the locking of the latch hooks 12, 12*a* being obtained by means of a locking bar 21 (FIGS. 3, 4,7 and 10). The bars 20 and 21 are constituted by flexible blades, made of steel, for example, sliding lengthwise one against the other. The control bar 20 is guided inside the housing 3 by bosses such as 22 and comprises flexible tabs 23 sliding against the cover 5 or the inside wall of the suitcase, the bar 20 thus holding the locking bar 21 in position, which locking bar is placed against the control bar.

The control bar 20 is provided at its two ends with two oblong apertures 24, 24*a* inside which are respectively engaged the studs 17, 17*a* of the latch hooks 12, 12*a* (FIGS. 1, 3 and 8), and in its central part, the bar 20 is provided with two stop members 25, 26 adapted to come into abutment against the boss 22 and against a face 27 of the housing in order to limit the travel of the bar.

The stop member 26 is provided with an orifice 28 inside of which is engaged a finger 29 integral with a push button 30 pivotally mounted about an axis 31 integral with the base plate 9 (FIGS. 9 and 10), the push button 30 being accessible from the outside through an opening 32 provided in the base plate 9.

The locking bar 21 (FIGS. 7 and 3) is provided at one of its ends with an oblong aperture 33 inside of which is engaged the stud 17*a* of the hook 12*a* and the bar is adapted to come into resting contact at its other end by its face 34 on the stud 17 of the latch hook 12*a* so as to hold the latch hooks in the locking position.

In its centre, the bar 21 is provided with two stop members 35, 36 adapted to come into abutment on the boss 22 and on the face 27 of the housing, one of the faces 35*a* of the stop member 35 being adapted to come into resting contact on a cam 37 actuated by means of a barrel lock 38 (FIGS. 1, 5 and 10), fitted on the housing by means of a screw 39.

The cover 2 is provided with a guiding finger 40 which is parallel to the keepers 1, 1*a* and moves simultaneously therewith, the finger 40 being adapted to engage in a recess 41 of the housing 3, the bottom of which includes a push button 42 subjected to the action of a spring 43 resting against the bottom of the casing and which tends to push back the finger 40 outside the recess in order to aid in the opening of the lock.

The locking device according to the invention operates as follows.

When the device is in the unlocked position and when the lid 2 is in the opened position, the latch hooks 12, 12*a* are returned by the springs to the position shown in FIG. 1. To close the cover, the keepers 1, 1*a* are engaged in the lock-staples 4, 4*a*, and when going through, because of their inclined portion 16 which cooperates with the inclined portion 15 of the latch hooks, they cause the latch hooks 12, 12*a* to rotate against the action of the springs 18, 18*a*, the latch hooks thereafter engaging the notches 14, 14*a* of the keepers 1, 1*a*, as shown in FIG. 1.

The movement of the studs 17, 17*a* is allowed because of the presence of the apertures 24, 24*a* provided in the control bar 20 and of the aperture 33 provided in the locking bar 21. During the closing operation, the finger 40 is engaged in the recess 41, pressing down the spring 43 of the push button 42. To ensure the locking arrangement, it suffices to turn the key in the lock 38 in order to cause the cam 37 to pivot and push back the stop member 35 against the boss 22 of the housing 3, holding the stop member 35 captive between the cam 37 and the boss 22. Since the locking bar 21 is driven towards the left, its face 34 comes into abutment on the stud 17 and its face 33*a* comes into abutment on the stud 17*a*, thus preventing any pivoting movement of the hooks 12, 12*a* about their axes 13, 13*a* and releasing them from the notches provided in the keepers.

The unlocking operation is a reverse operation, and consists of acting on the lock to turn the cam 37 which releases the stop member 36 and, as a result, the bar 21, thereby permitting its movement towards the right when the latch hooks are actuated by means of the control bar 20.

To open the lid of the suitcase, it suffices to actuate the push button 30, to cause it to pivot about its axis 31 and come into the position shown in broken lines, and the finger 29 of the pushbutton acts on the control bar 20 (FIGS. 8, 10) which bar moves towards the right so that the studs 17, 17*a* integral with the latch hooks 12, 12*a* cause the latter to pivot about the axes 13, 13*a*, releasing them from the notches 14, 14*a* of the keepers 1, 1*a*. The keepers are no longer held by the latch hooks, and can be released from the lock-staples 14, 14*a*, the finger 40 aiding in the opening under the action of the pushbutton 42 and of its spring 43.

FIGS. 11, 12 and 13 show another means for controlling the bar 20 in which a push-button 44 is mounted in a sliding relation longitudinally on the base plate 9 of the handle, inside of which is provided an oblong hole 45 crossed through by a finger 46 of the push button which moves inside the hole and which is held in position by an elastic washer 47. The end of the finger 46 is engaged in the orifice 28 of the control bar 20 for driving the latter, as described above.

FIG. 15 show another embodiment of the means for controlling the bar 20, in which a pushbutton 48 is pivotally mounted about an axis 49 integral with the base plate 9 of the handle. At the opposite end of the axis 49, the push button 48 is provided with a recess 50 inside of which is slidably mounted a boss 51*a* of a lever 51 mounted to pivot about an axis 52 parallel to the axis 49 and integral with the base plate 9 of the handle. The lever 51 is integral with a finger 53 which is engaged in the orifice 28 of the control bar 20 in order to drive the latter, as described above.

Various modifications may of course be made by anyone skilled in the art to the devices and methods described hereinabove without departing from the scope of the invention as defined in the claims of this application.

What is claimed is:

1. A locking device for use in suitcases, comprising:

a housing including two elements adapted to be assembled, keepers in one of said elements, each keeper having a lateral notch and an outermost surface inclined to form a cam, lock-staples in the other of said elements, each lock-staple adapted to engage a respective keeper therein, latch hooks, each pivotally mounted inside a respective one of said lock-staples and adapted to be engaged in a notch provided in a respective keeper, elastic members, each associated with a latch hook for biasing the associated latch hook in said notch provided in said respective keeper, an opening control bar axially slidably mounted within said housing and selectively engageable with said latch hooks, and a locking bar axially slidably mounted within said housing and selectively engageable with said latch hooks.

2. A device as claimed in claim 1, wherein the control and locking bars are constituted by flexible plates sliding one against the other in the housing.

3. A device as claimed in claim 1 or 2, further comprising a control member having a finger, and wherein each latch hook has a stud integral therewith, and the control bar has two ends with apertures inside of which are received and selectively engaged the studs integral with the latch hooks, said control bar further having a middle part provided with two stop members cooperating with walls of the housing, one of said stop members including an orifice inside of which is engaged the finger of the control member.

4. A device as claimed in claim 1 or 2, further comprising a cam, a locking member for controlling the cam, and wherein the locking bar has one end provided with an orifice inside which is received and selectively engaged a stud integral with one of the latch hooks, and another end adapted to come into abutment with a stud integral with another latch hook, said locking bar having a central part provided with two stop members cooperating with walls of the housing, one of said stop members including a shoulder against which said cam is adapted to come into resting contact.

5. A device as claimed in claim 2, further comprising a finger adapted to be engaged in a hole in the control bar, and a control member including a push button mounted to pivot about one of an axis integral with the housing and a plate added onto the housing, said axis being perpendicular to the finger.

6. A device as claimed in claim 3, wherein the control member includes a push button mounted in a sliding relation inside one of a recess of the housing and a plate added onto the housing, and in parallel with the control bar which is provided with said orifice inside of which is engaged the finger said control member.

7. A device as claimed in claim 3, wherein said control member includes a lever pivotally mounted to one of the housing and a plate added onto the housing, said lever having a boss and said finger integral therewith and the control member further includes a push button pivotally mounted at one end thereof on one of the housing and a plate added onto said housing, said push button having another end provided with a recess inside of which is engaged the boss of said lever.

8. A device as claimed in claim 1, in which said keepers are secured to a portion of the suitcase, further comprising a guiding finger secured to said portion of the suitcase, and wherein the housing has a central part provided with a recess inside of which is engaged said guiding finger in a closed position of said suitcase, said finger, in said closed position, being arranged in the bottom of the recess and subjected to the action of an elastic member therein.

* * * * *